US008491071B2

(12) United States Patent
Komori et al.

(10) Patent No.: US 8,491,071 B2
(45) Date of Patent: Jul. 23, 2013

(54) DROPLET DISCHARGE DEVICE, METHOD FOR DISCHARGING DROPLETS, AND METHOD FOR MANUFACTURING COLOR FILTER

(75) Inventors: Sadaharu Komori, Nagano (JP); Tsuyoshi Kato, Nagano (JP); Tamotsu Goto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 541 days.

(21) Appl. No.: 12/717,700

(22) Filed: Mar. 4, 2010

(65) Prior Publication Data

US 2010/0239743 A1 Sep. 23, 2010

(30) Foreign Application Priority Data

Mar. 17, 2009 (JP) ..... 2009-064004

(51) Int. Cl.
*B41J 2/195* (2006.01)
*B41J 29/393* (2006.01)
*B41J 2/175* (2006.01)

(52) U.S. Cl.
USPC ..... 347/7; 347/19; 347/86

(58) Field of Classification Search
None
See application file for complete search history.

(56) References Cited

U.S. PATENT DOCUMENTS

| | | | | |
|---|---|---|---|---|
| 6,158,858 | A | 12/2000 | Fujiike et al. | |
| 2003/0007023 | A1* | 1/2003 | Barclay et al. | 347/8 |
| 2004/0141041 | A1* | 7/2004 | Tsutsumi et al. | 347/102 |
| 2006/0121202 | A1* | 6/2006 | Endo et al. | 427/372.2 |
| 2006/0170726 | A1* | 8/2006 | Hirakawa | 347/21 |
| 2007/0040859 | A1* | 2/2007 | Kimura | 347/7 |
| 2007/0176994 | A1* | 8/2007 | Silverbrook et al. | 347/102 |

FOREIGN PATENT DOCUMENTS

JP 10-260306 A 9/1998

* cited by examiner

*Primary Examiner* — Stephen Meier
*Assistant Examiner* — Alexander C Witkowski
(74) *Attorney, Agent, or Firm* — Global IP Counselors, LLP

(57) ABSTRACT

A droplet discharge device includes a droplet discharge head, a feed reel, a drying chamber, a drying-gas-introducing device, a take-up reel, an imaging device, an analyzing unit and a control unit. The imaging device captures an image of functional liquid discharged from nozzles of the droplet discharge head onto a sheet member between the feed reel and the take-up reel with the sheet member having been dried in the drying chamber filled with a drying gas to achieve a predetermined humidity. The analyzing unit measures an area over which the functional liquid is deposited on the sheet member from each of the nozzles, and calculates a distribution of a discharge amount of the functional liquid. The control unit adjusts a voltage applied to the drive elements so that the discharge amount of the functional liquid from each of the nozzles approximates a predetermined optimum amount.

7 Claims, 6 Drawing Sheets

DROPLET DISCHARGE DEVICE, METHOD FOR DISCHARGING DROPLETS, AND METHOD FOR MANUFACTURING COLOR FILTER

CROSS-REFERENCE TO RELATED APPLICATIONS

This application claims priority to Japanese Patent Application No. 2009-064004 filed on Mar. 17, 2009. The entire disclosure of Japanese Patent Application No. 2009-064004 is hereby incorporated herein by reference.

BACKGROUND

1. Technical Field

The present invention relates to a droplet discharge device, a method for discharging droplets, and a method for manufacturing a color filter.

2. Related Art

In recent years, liquid crystal devices, organic electroluminescent (EL) devices, and other electro-optic devices have been used in displays for mobile telephones, mobile computers, and other electronic equipment. These electro-optic devices are generally used for full-color display. For example, full-color display in a liquid crystal device is carried out by passing light modulated by a liquid crystal layer through a color filter. Such a color filter is formed by discharging ink in a dotted shape onto a substrate surface by using a film formation technique that makes use of a droplet discharge method.

In film formation techniques that use the droplet discharge method, slight variability occurs in the ink discharge amount from a plurality of nozzles. There are cases in which linear grayscale nonuniformity (stripes) occurs in the color filter when drawing is carried out in a state in which there is nonuniformity in the ink discharge amount. Such stripes are readily visible and are liable to reduce the quality of the image displayed via the color filter.

Techniques for solving such problems have been studied, and in Japanese Laid-Open Patent Application No. 10-260306, for example, a target coloring medium is colored to a plurality of different ink discharge densities, the color concentration of the colored portions is measured, and the relationship between the color concentrations of the colored portions that have been colored to a plurality of different ink discharge densities, and the corresponding ink discharge densities is calculated. Loss of image display quality is reduced by making corrections on the basis of the relationship so as to achieve an ink discharge density in which a desired color concentration is obtained.

SUMMARY

In Japanese Laid-Open Patent Application No. 10-260306, the color concentrations of the colored portions that have been colored to a plurality of different ink discharge densities are expressed by the light absorbance of the colored portions of the target coloring medium. When an error is produced in the measurement of the light absorbance, it is not possible to make corrections with high precision and it may be difficult to avoid a loss of image quality.

In another conventionally used method, the weight of the ink discharged from a plurality of nozzles is measured. However, this method is not preferred in that production efficiency is reduced because measurement is not easy and considerable labor is required to measure the weight of the ink.

The present invention was contrived in view of such circumstances, it being an object thereof to provide a droplet discharge device, a method for discharging droplets, and a method for manufacturing a color filter that can reduce a loss of image quality without noticeable striping and in which production efficiency is improved.

In order to solve the problems described above, the droplet discharge device according to one aspect includes a droplet discharge head, a feed reel, a drying chamber, a drying-gas-introducing device, a take-up reel, an imaging device, an analyzing unit and a control unit. The droplet discharge head has a plurality of nozzles configured and arranged to discharge a functional liquid, and a plurality of drive elements provided in correspondence with the nozzles. The feed reel is configured and arranged to feed a sheet member. The drying chamber accommodates the sheet member and the feed reel. The drying-gas-introducing device is configured and arranged to introduce a drying gas to the drying chamber so that the interior of the drying chamber reaches a predetermined humidity. The take-up reel is configured and arranged to take up the sheet member fed from the feed reel. The imaging device is configured and arranged to capture an image of the functional liquid discharged from the nozzles onto the sheet member between the feed reel and the take-up reel with the sheet member having been dried in the drying chamber filled with the drying gas. The analyzing unit is configured to perform image processing on the image captured by the imaging device, to measure an area over which the functional liquid is deposited on the sheet member from each of the nozzles, and to calculate a distribution of a discharge amount of the functional liquid from each of the nozzles based on the measured areas. The control unit is configured to adjust a voltage applied to the drive elements so that the discharge amount of the functional liquid from each of the nozzles approximates a predetermined optimum amount from the distribution.

In accordance with this aspect, a drying chamber is filled with a drying gas by a drying gas-introducing device so that a predetermined humidity is achieved, and the sheet member is placed in the chamber whereby the surface thereof is dried. An image of the deposited ink (functional liquid) discharged from a plurality of nozzles is captured by an imaging device. The distribution of the amount of ink discharged from the plurality of nozzles is calculated by analyzing unit on the basis of the area over which the ink discharged from the plurality of nozzles is deposited. At this point, the voltage applied to the drive elements by control unit is adjusted so that the amount of ink discharged from the nozzles approximates a predetermined optimal amount. In other words, nonuniformity of the amount of ink discharged from the nozzles is corrected by the control unit. Accordingly, it is possible to discharge a uniform amount of ink from all nozzles of the droplet discharge heads. Since the surface of the sheet member is dried, nonuniformity of the area of the sheet member over which the ink is deposited is reduced. In other words, the surface of the sheet member has a predetermined permeability in relation to the ink, and the permeability must be kept uniform, but the permeability of the surface in reality becomes nonuniform due to some cause (e.g., airborne moisture penetrating the ink reception layer of the surface of the sheet member) between the time the sheet member is stored and the time the sheet member is used (e.g., the ink deposition step), which leads to problems in the measurement of the area on the sheet member over which the ink is deposited. In view of this situation, in the droplet discharge device of the present invention, before any ink is deposited, the sheet member is accommodated in advance in the drying chamber set to a predetermined humidity by the drying-gas-introducing device, and the surface of the sheet member is dried to make the permeability of the surface uniform. The area on the sheet member over which the ink is deposited can thereby be measured with good precision. High controllability can be achieved when the ink deposit amount is adjusted thereafter. Accordingly, the ink deposit surface area for all the nozzles of the droplet discharge heads can be made uniform. Therefore, striping can be made unnoticeable and a loss of image quality can be reduced. Having a larger number of steps, conventional methods of weighing ink discharged from a plurality of nozzles offer lower productivity than what is achieved by a method wherein the surface of the sheet member is dried through being accommodated in a drying chamber filled with drying gas by a drying-gas-introducing device so that a predetermined humidity is obtained, and the distribution of the amount of ink discharged from the plurality of nozzles is calculated on the basis of the area over which the ink is deposited by the nozzles. The deposit surface area is measured with good efficiency because the sheet member on which the ink discharged from the plurality of nozzles has been deposited is suitably conveyed.

In the droplet discharge head described above, the predetermined humidity is preferably set to 40% or less.

In accordance with this aspect, nonuniformity of the surface area of ink deposited on the sheet member is considerably reduced because the drying chamber is filled with drying gas so that the humidity reaches 40% or less, and the surface of the sheet member is suitably dried. In the particular case of a droplet discharge device having a plurality of processing devices, the humidity of the entire line is set to 50 to 60%. Therefore, it is difficult to locally set, e.g., only the environment (the atmosphere within which ink is deposited on the sheet member) for discharging ink from the droplet discharge heads to a humidity of 40% or less. Accordingly, setting the atmosphere; i.e., the humidity, to 40% or less inside the drying chamber before the ink is deposited on the sheet member leads to a dramatic effect because the surface of the sheet member will be suitably dried before the ink is deposited.

The sheet member may have a porous ink reception layer in which pigment is bound by a binder.

In accordance with this aspect, a highly uniform amount of ink is discharged from all the nozzles of the droplet discharge heads, and the ink deposit surface area for all the nozzles is considerably more uniform. In the particular case that the sheet member has a porous ink reception layer, the spaces of the ink reception layer fill with absorbed moisture and the size of the spaces readily lost uniformity. Therefore, a dramatic effect is achieved because the permeability of the surface of the ink reception layer is considered to be a parameter that must be kept uniform.

A method for discharging droplets according to another aspect includes feeding a sheet member that has been accommodated and dried in a drying chamber filled with a drying gas so that a predetermined humidity is achieved within the drying chamber, depositing a functional liquid on the sheet member from a plurality of nozzles of a droplet discharge head by applying a voltage to each of a plurality of drive elements provided in correspondence with the nozzles after the sheet member is fed, measuring a first area over which the functional liquid is deposited on the sheet member from each of the nozzles, and calculating a distribution of a discharge amount of the functional liquid from each of the nozzles based on the measured first areas, and adjusting the voltage applied to the drive elements so that the discharge amount of the functional liquid from each of the nozzles approximates a predetermined optimum amount from the distribution.

In accordance with this manufacturing method, the first dry sheet member feed step feeds a sheet member dried by being accommodated in a drying chamber filled with drying gas so that a predetermined humidity is achieved. Accordingly, nonuniformity of the area on the sheet member over which the ink is deposited is reduced in the first deposition step that follows the first dry sheet member feed step. The distribution of the amount of ink discharged from the nozzles is calculated by the first analyzing step that follows the first deposition step. In the first control step, the amount of ink discharged from the nozzles is adjusted so as to approximate a predetermined optimal amount. Nonuniformity of the amount of ink discharged from the nozzles is thereby corrected. Accordingly, it is possible to discharge a uniform amount of ink from all the nozzles of the droplet discharge heads and to make the ink deposit surface area for all the nozzles uniform. Therefore, the loss of image quality is reduced without noticeable striping.

In the method for discharging droplets described above, the predetermined humidity is preferably set to 40% or less.

In accordance with this manufacturing method, the interior of the drying chamber is filled with a drying gas in the first dry sheet member feed step so that the humidity is 40% or less, and the surface of the sheet member is suitably dried. Therefore, the nonuniformity of the ink discharge surface area on the sheet member is considerably reduced. In the particular case of a droplet discharge device having a plurality of processing devices, the humidity of the entire line is set to 50 to 60%. Therefore, it is difficult to locally set, e.g., only the environment (the atmosphere for depositing ink on the sheet member) for discharging ink from the droplet discharge heads to a humidity of 40% or less. Accordingly, a dramatic effect is achieved because the surface of the sheet member is suitably dried before ink deposition by having the atmosphere, i.e., the humidity, set to 40% or less inside the drying chamber before the ink is deposited on the sheet member.

The method for discharging droplets described above preferably has at least one cycle of feeding an additional sheet member accommodated and dried in the drying chamber filled with the drying gas after the adjusting of the voltage applied to the drive elements, depositing the functional liquid on the additional sheet member from the nozzles by applying the adjusted voltage to the drive elements, measuring a second area over which the functional liquid is deposited on the additional sheet member from each of the nozzles, and calculating a distribution of a discharge amount of the functional liquid from each of the nozzles based on the measured second areas, and readjusting the voltage applied to the drive elements so that the discharge amount from each of the nozzles approximates the predetermined optimum amount from the distribution.

In accordance with this manufacturing method, a dry sheet member feed step, a deposition step, an analyzing step, and a control step are repeated a plurality of cycles after the first control step, whereby the nonuniformity of the amount of ink discharged from the nozzles and the nonuniformity of the deposit surface area of the plurality of nozzles is reliably adjusted. Accordingly, it is possible to discharge a highly uniform amount of ink from all the nozzles of the droplet discharge heads and to make the ink deposit surface area for all the nozzles uniform. Therefore, the loss of image quality is considerably reduced without noticeable striping.

A method for manufacturing a color filter according to another aspect includes arranging the functional liquid in a predetermined region provided on a substrate to form a color filter using the method for discharging droplets as described above.

In accordance with this manufacturing method, it is possible to discharge a uniform amount of ink from all the nozzles of the droplet discharge heads as described above and to make the ink deposit surface area for all the nozzles uniform. Therefore, a high quality color filter can be manufactured without striping.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
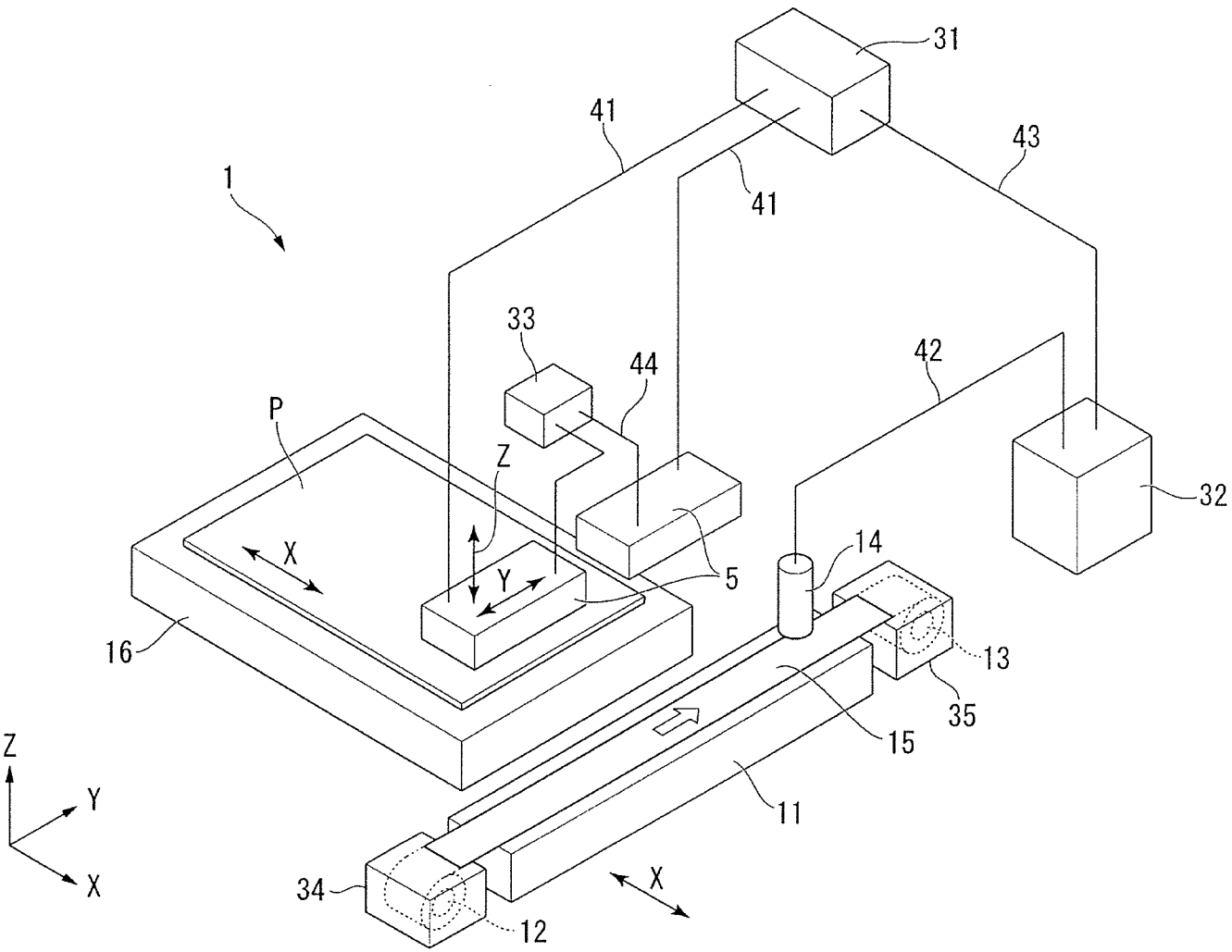
FIG. 1 is a schematic view showing a configuration of the droplet discharge device of the present invention.

Embodiments of the present invention are described below with reference to the drawings. The embodiments show a mode of the present invention, do not limit the present invention, and may be arbitrarily modified within the scope of the technical concepts of the present invention. In the drawings below, the measurements, number, and other attributes of each structure may be different from the actual structure in order to facilitate understanding of each configuration.

An XYZ rectangular coordinate system is established in FIG. 1 and the members in the description below will be described with reference to the XYZ rectangular coordinate system. The XYZ rectangular coordinate system is established so that the X- and Y-axes are set in directions parallel to the work stage 16, and the Z-axis is set in the direction orthogonal to the work stage 16. The XYZ rectangular coordinate system in FIG. 1 is established so that the XY plane is actually parallel to the horizontal plane, and the Z-axis is set in the perpendicularly vertical direction.

Droplet Discharge Device

FIG. 1 is a schematic view showing the schematic configuration of the droplet discharge device of the present invention. The droplet discharge device 1 is a device for discharging droplets of a color filter material (functional liquid) in a predetermined region of a color filter substrate (base material) P using, e.g., an inkjet scheme to form a color filter layer.

The droplet discharge device 1 is used for carrying out the droplet discharge method of the present invention.

Figure 2:
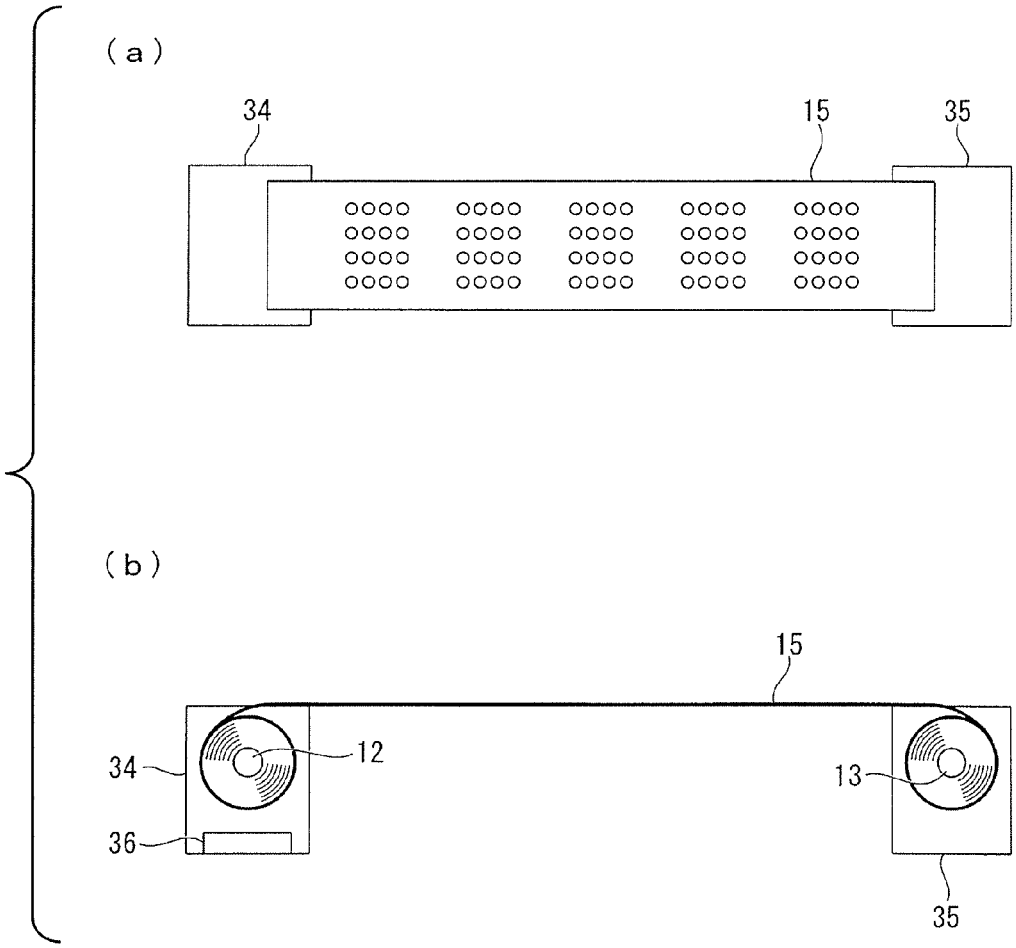
FIG. 2 is a schematic view showing a configuration of the vicinity of the drying chamber of the droplet discharge device.

The droplet discharge device 1 has a work stage 16, droplet discharge heads 5, tubes 44, a tank 33, a sheet member conveyor platform 11, a feed reel 12, a take-up reel 13, a surface area measurement camera (imaging device) 14, a control unit (control means) 31, an analyzing unit (analyzing means) 32, a drying chamber 34, a drying-gas-introducing device 36 (see FIG. 2(*b*)), an accommodation chamber 35, a first wire 41, a second wire 42, and a third wire 43.

The work stage 16 is disposed so as to allow movement in the X-axis direction using a stage movement device (not shown). The work stage 16 holds the color filter substrate P conveyed from a conveyance device (not shown) in the XY plane using a vacuum chucking mechanism (not shown).

The droplet discharge heads 5 are electrically connected to the control unit 31 via the first wire 41. The droplet discharge heads 5 have a plurality of nozzles N (see FIG. 2), and discharge droplets of a color filter material on the basis of drawing data and drive control signals inputted from the control unit 31. The droplet discharge heads 5 are arranged in correspondence with R (red), G (green), and B (blue) of the color filter material. The droplet discharge heads 5 are in communication with the tank 33 via the tubes 44.

The droplet discharge heads 5 are provided with a ball screw, a linear guide, or another bearing mechanism (not shown) in the Y- and Z-axis directions. The droplet discharge heads 5 can move in the Y- and Z-axis directions on the basis of position control signals expressed in terms of Y and Z coordinates inputted from the control unit 31.

The tubes 44 are used to feed the color filter material and connect the tank 33 and the droplet discharge heads 5. The tank 33 stores three color filter materials, namely, R (red) color filter material, G (green) color filter material, and B (blue) color filter material. The tank 33 stores color filter material for three colors and feeds the color filter material to the droplet discharge heads 5 that correspond to the three colors via the tubes 44.

The sheet member conveyor platform 11 can be moved by a conveyance platform movement device (not shown) in the X-axis direction. The sheet member conveyor platform 11 is a platform for conveying a strip-shaped sheet member 15 fed from the feed reel 12. The sheet member 15 thus fed from the feed reel 12 is taken up by the take-up reel 13.

The drying chamber 34 is disposed in a position adjacent to one end of the sheet member conveyor platform 11. The drying chamber 34 accommodates the sheet member 15 and the feed reel 12. A drying-gas-introducing device 36 for filling the interior of the drying chamber 34 with drying has so that a predetermined humidity is reached is accommodated in the drying chamber 34. The drying-gas-introducing device 36 will be described later (see FIG. 2(*b*)).

The accommodation chamber 35 is disposed in a position facing the drying chamber 34 via the sheet member conveyor platform 11. The accommodation chamber 35 is disposed in a position adjacent to the other end of the sheet member conveyor platform 11. The accommodation chamber 35 accommodates the take-up reel 13 and the sheet member 15 fed from the feed reel 12.

The sheet member 15 is a recording medium on which it is possible to record an area where ink (functional liquid) discharged from the plurality of nozzles N of the droplet discharge heads 5 is deposited in a punctate (dotted) arrangement. For example, roll paper or another recording paper can be used as the sheet member 15. As another example, a glass substrate or another substrate having liquid repellency may be used in place of roll paper as the sheet member 15. Other examples that may be used as the sheet member 15 include paper, or a sheet provided with an ink reception layer in a plastic film.

In the present embodiment, a sheet provided with an ink reception layer in a plastic film is used as the sheet member 15. The ink reception layer is described hereinbelow (see FIG. 6).

The sheet member 15 may also be used for confirming the discharge state (missing and deflected nozzles) of the plurality of nozzles N of the droplet discharge heads 5 prior to production; i.e., drawing on the color filter substrate P.

The surface area measurement camera 14 is disposed in a position facing the recording surface (upper surface) of the sheet member 15 on the sheet member conveyor platform 11. The surface area measurement camera 14 is a camera for imaging the deposit surface area of the ink discharged from the plurality of nozzles N to the sheet member 15. The surface area measurement camera 14 is electrically connected to the analyzing unit 32 via the second wire 42. The surface area measurement camera 14 presents to the analyzing unit 32 image data of the deposit surface area of the imaged ink.

The analyzing unit 32 has a function for processing image data of the deposit surface area of the ink imaged by the surface area measurement camera 14, measuring the deposition surface area, and calculating the distribution of the amount of ink discharged from the nozzles N on the basis of the measurement data of the obtained deposit surface area. The analyzing unit 32 is electrically connected to the control unit 31 via the third wire 43. The analyzing unit 32 presents to the control unit 31 the measurement data of the distribution of the amount of ink discharged from the nozzles N.

The control unit 31 adjusts the voltage applied to piezoelectric elements PZ (see FIG. 3) on the basis of the measurement data of the amount of ink discharged from the nozzles N inputted from the analyzing unit 32. Specifically, the voltage applied to the piezoelectric elements PZ is adjusted so that the amount of ink discharged from the nozzles N approximates a predetermined optimal amount. Nonuniformity of the amount of ink discharged from the nozzles N is adjusted by the piezoelectric elements PZ. In other words, nonuniformity in the amount of ink discharged from the nozzles N is corrected.

After the nonuniformity of the amount of ink discharged from the nozzles N has been corrected, droplets of the color filter material are discharged from the plurality of nozzles N of the droplet discharge heads 5 to predetermined positions on the color filter substrate P.

FIG. 2 is a schematic view showing the schematic configuration of the vicinity of the drying chamber 34 of the droplet discharge device 1. FIG. 2(*a*) is a plan view of the vicinity of the drying chamber 34, and FIG. 2(*b*) is a cross-sectional view of the vicinity of the drying chamber 34.

The drying chamber 34 has a box shape and is disposed so as to partially overlap one end of the sheet member 15, as shown in FIG. 2(*a*). The accommodation chamber 35 has a box shape and is disposed so as to partially overlap the other end of the sheet member 15. The sheet member 15 extends in the lateral direction in the drawing. The dot-shaped deposition surface area of the ink discharged from the plurality of nozzles N of the droplet discharge heads 5 is recorded on the surface of the sheet member 15.

The sheet member 15 and the feed reel 12 are accommodated in the drying chamber 34, and the drying-gas-introducing device 36 is accommodated in the bottom part of the drying chamber, as shown in FIG. 2(*b*). The drying-gas-introducing device 36 has a function for filling the drying chamber 34 with drying gas so that a predetermined humidity is achieved. Air or nitrogen gas, for example, can be used as the drying gas introduced by the drying-gas-introducing device 36. In this manner, the drying chamber 34 is filled with drying gas by the drying-gas-introducing device 36 accommodated in the drying chamber 34 so that a predetermined humidity is achieved, and the surface of the sheet member 15 is dried.

In the present embodiment, the drying chamber 34 is filled with drying gas so that the humidity is 40% or less. The surface of the sheet member 15 is thereby dried to a suitable level. In the particular case of a droplet discharge device 1 having a plurality of processing devices, the humidity of the entire line is set to 50 to 60%. Therefore, it is difficult to locally set, e.g., only the environment (the atmosphere for depositing ink on the sheet member 15) for discharging ink from the droplet discharge heads 5 to a humidity of 40% or less. Accordingly, the surface of the sheet member 15 is suitably dried by setting at least the atmosphere, i.e., the humidity to 40% or less inside the drying chamber 34 in which the sheet member 15 is accommodated, before the ink is deposited on the sheet member 15.

Figure 3:
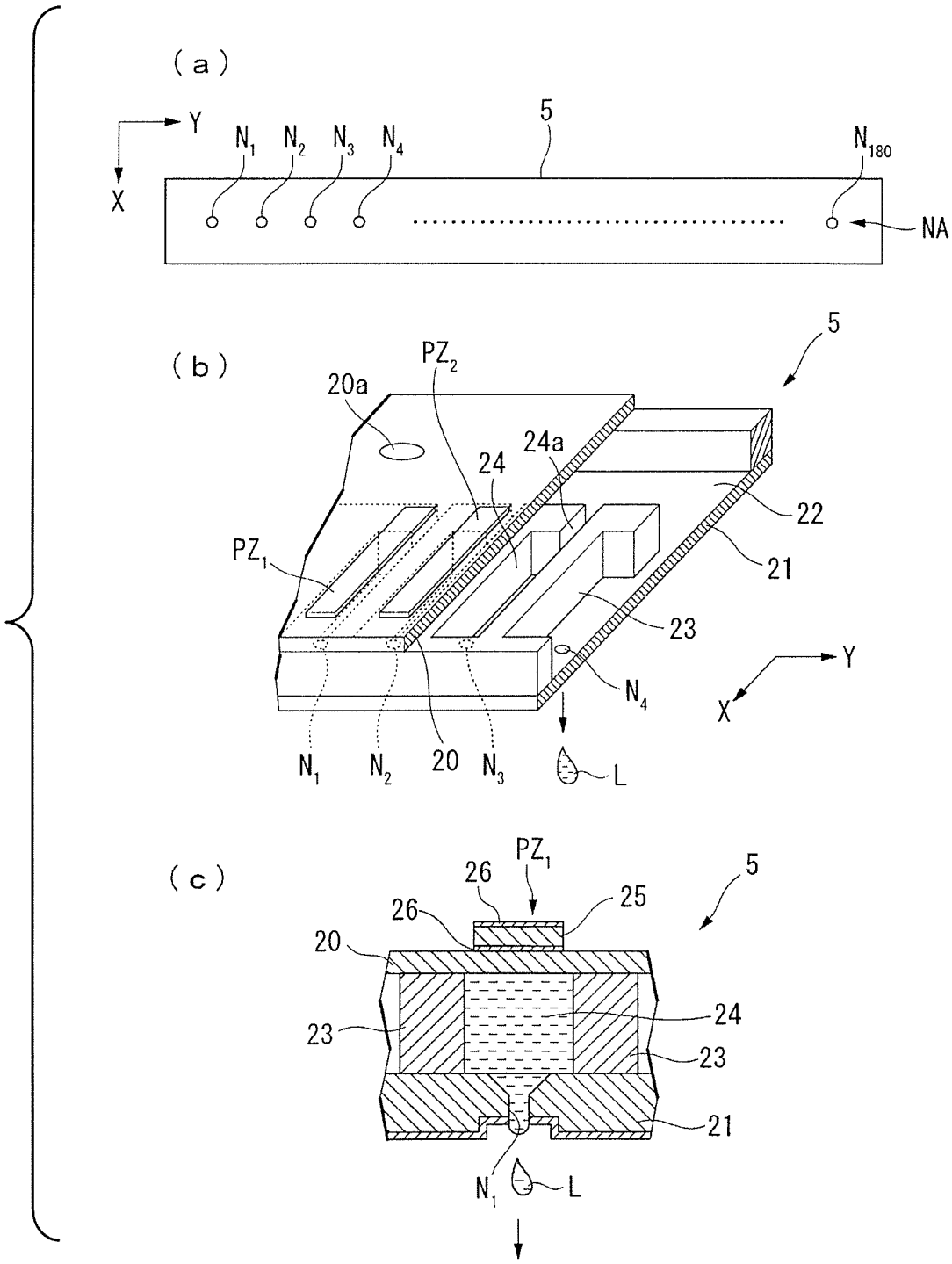
FIG. 3 is a schematic view showing a configuration of the droplet discharge head.

FIG. 3 is a schematic view showing the schematic configuration of the droplet discharge head 5. FIG. 3(*a*) is a plan view of the droplet discharge heads 5 as seen from the work stage 16; FIG. 3(*b*) is a partial perspective view of the droplet discharge heads 5; and FIG. 3(*c*) is a partial cross-sectional view of a single nozzle of the droplet discharge heads 5.

The droplet discharge heads 5 is provided with a plurality (e.g., 180) of nozzles $N_1$ to $N_{180}$ arrayed in the Y-axis direction, as shown in FIG. 3(*a*). A nozzle array NA is formed by the nozzles $N_1$ to $N_{180}$. A single nozzle row is shown in FIG. 3(*a*), but the number of nozzles and the number of row provided to the droplet discharge heads 5 can be modified as desired, and a single row of nozzles arrayed in the Y-axis direction may also be a plurality of rows arrayed in the X-axis direction.

Each of the droplet discharge heads 5 has a vibration plate 20 provided with a material feed hole 20*a* connected to the tube 44, a nozzle plate 21 provided with the nozzles $N_1$ to $N_{180}$, a liquid reservoir 22 provided between the vibration plate 20 and the nozzle plate 21, a plurality of partition walls 23, and a plurality of storage chambers 24, as shown in FIG. 3(*b*). Drive elements $PZ_1$ to $PZ_{180}$ are arranged on the vibration plate 20 in correspondence with the nozzles N1 to N180. The drive elements $PZ_1$ to $PZ_{180}$ are, e.g., piezoelements.

The liquid reservoir 22 is filled with a liquid color filter material fed via the material feed hole 20*a*. Each of the storage chambers 24 is enclosed by a vibration plate 20, a nozzle plate 21, and a pair of partition walls 23. The storage chambers 24 are provided in one-to-one correspondence to the nozzles $N_1$ to $N_{180}$. The color filter material is introduced from the liquid reservoir 22 into the each storage chamber 24 via a feed port 24*a* disposed between the pair of partition walls 23.

The drive element $PZ_1$ has a piezoelectric material 25 held between a pair of electrodes 26, as shown in FIG. 3(*c*). The drive element $PZ_1$ is configured so that the piezoelectric material 25 contracts when a drive signal is applied to the pair of electrodes 26. The vibration plate 20 in which such a drive element $PZ_1$ is arranged is designed to flex outward (the side opposite from the storage chambers 24) in integral fashion with the drive element $PZ_1$ when a drive signal is applied to the pair of electrodes 26, whereby the volume of the storage chamber 24 increases.

Therefore, an amount of color filter material commensurate with the increased volume flows into the storage chambers 24 from the liquid reservoir 22 via the feed port 24*a*. When the application of a drive signal to the drive element $PZ_1$ is stopped in such a state, the drive element $PZ_1$ and the vibration plate 20 return to their original shapes and the volume of the storage chamber 24 is also restored. Accordingly, the pressure of the color filter material inside the storage chamber 24 increases, and droplets L of the color filter material are discharged from the nozzle $N_1$ toward the color filter substrate P. A micro vibration can be generated in the storage chamber 24 and the ink discharge amount can be adjusted with good precision by using a drive element $PZ_1$.

Figure 4:
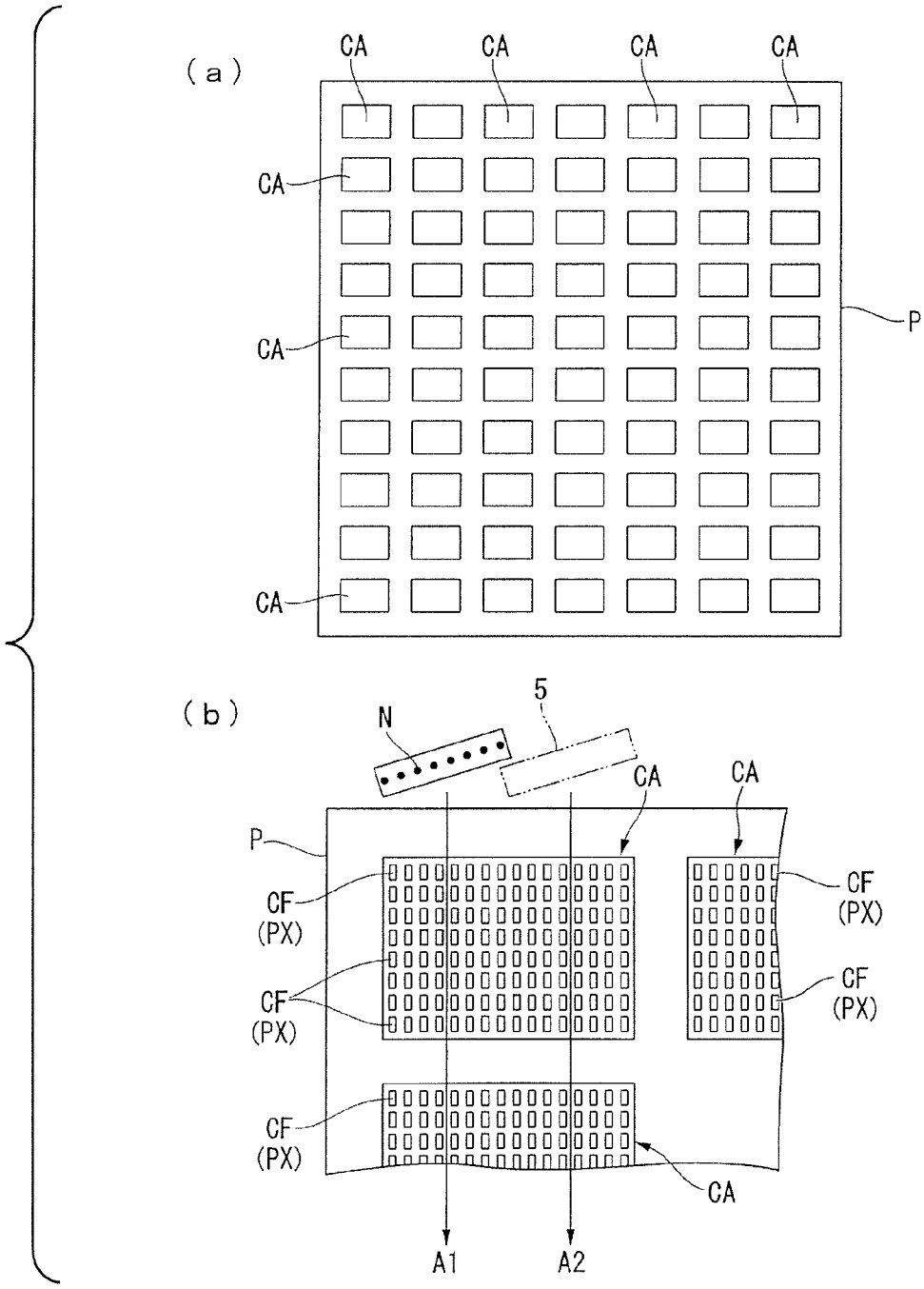
FIG. 4 is a view illustrating the method for forming a color filter on the color filter substrate.

FIG. 4 is a descriptive view of the method for forming a color filter layer (color filter) CF on the color filter substrate P using the droplet discharge heads 5. FIG. 4(*a*) is a schematic plan view of the color filter substrate P as an ink discharge target. FIG. 4(*b*) is a partial enlarged plan view of the color filter substrate P.

In FIG. 4(*a*), a plurality of panel regions CA are established on the surface of a large-surface area color filter substrate P made of glass, plastic, or the like. The panel regions CA are separated (cut) from each other and provided as individual color filter substrates. A plurality of pixels PX (predetermined region) arrayed in the form of dots is provided inside the panel regions CA, as shown in FIG. 4(*b*). The pixels PX are arrayed in the form of a matrix in the panel regions CA, and a color filter layer (colored layer) CF is formed for each of the pixels PX.

The vertical direction (the direction indicated by arrows A1 and A2) of FIG. 4(*b*) is the main scanning direction, and the direction (the lateral direction of the drawing) orthogonal to the main scanning direction is the sub-scanning direction. The droplet discharge heads 5 are arranged on the color filter substrate P. Ink containing coloring material (color filter material) is discharged from the plurality of nozzles N of the droplet discharge heads 5 while the color filter substrate P is moved (as a scan) in a relative fashion in the main scanning direction and the sub-scanning direction relative to the droplet discharge heads 5 to form a color filter layer CF on the pixels P on the color filter substrate P.

The scanning of the droplet discharge heads 5 is carried out a plurality of cycles in relation to a single panel regions CA. For example, the droplet discharge heads 5 are moved as a scan in the main scanning direction, the droplet discharge heads 5 are then moved (as a scan) in the sub-scanning direction, and subsequently moved again in the main scanning direction. When the droplet discharge heads 5 are moved (as a sub-scan) from the left end to the right end of a single panel regions CA, the droplet discharge heads 5 are again returned to the left end of the panel regions CA and moved as a scan in the main scanning direction in a position slightly different from the position to which a discharge has already been made. Such scanning is carried out a plurality of cycles, whereby a color filter layer CF having a desired thickness is formed on all the pixels PX in the panel regions CA.

In FIG. 4(*b*), the reason that the droplet discharge heads 5 are obliquely inclined in the sub-scanning direction is so that the pitch of the nozzles N of the droplet discharge heads 5 conforms to the pitch of the pixels PX. The droplet discharge heads 5 are not required to be obliquely inclined as long as the pitch of the nozzles N and the pitch of the pixels PX are set so as to satisfy a predetermined relationship.

The color filter layer CF is formed by arraying the colors R, G, and B in a so-called stripe array, delta array, mosaic array, or another suitable array mode. Therefore, in the ink discharge step shown in FIG. 4(*b*), the three droplet discharge heads 5 for the colors R, G, and B for discharging R, G, and B color filter material are prepared in advance. These droplet discharge heads 5 are used in sequence to form an array of three R, G, and B color filter layers CF on a single color filter substrate P.

Figure 7:
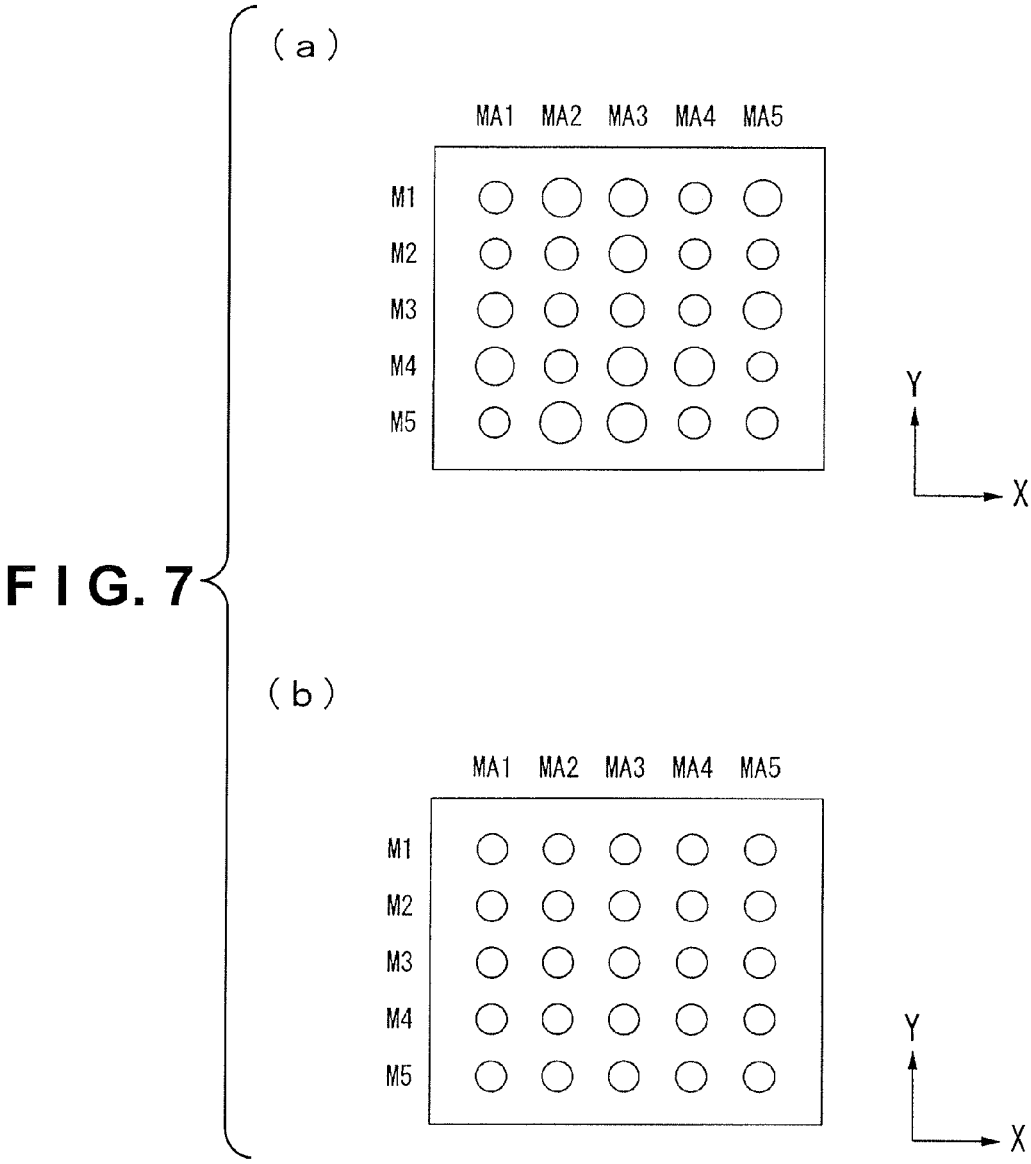
FIG. 7 is a diagram showing the state of arrangement of the ink before and after the nonuniformity of the deposition surface area has been corrected.

In a common droplet discharge head, there is a small amount of nonuniformity in the ink discharge characteristics (discharge amount) among nozzles (see FIG. 7(*a*)). Nonuniformity in the ink discharge amount among nozzles causes variability in the amount of ink (deposit surface area) arranged on the color filter substrate P, and causes striping to occur in the color filter.

FIG. 7 is a diagram showing the state of arrangement of the ink on the sheet member 15 before and after correction of the nonuniformity of the ink deposition surface area in the plurality of nozzles N. FIG. 7(*a*) shows the state of arrangement of the ink prior to correction of the nonuniformity of the deposit surface area, and FIG. 7(*b*) shows the state of arrangement of the ink after correction of the nonuniformity of the deposit surface area. In FIG. 7, M (M1 to M5) shows the state of arrangement of the ink in correspondence to the plurality of nozzles N arrayed in the Y-axis direction described above. MA (MA1 to MA5) show the arranged rows of ink in correspondence with a plurality of nozzle rows NA in which the single row of nozzles arrayed in the Y-axis direction described above is disposed as a plurality of rows in the X-axis direction. The presence of nonuniformity of the deposit surface area overall is apparent from the state of arrangement of the ink in correspondence to the plurality of nozzles N and the plurality of nozzle rows NA, as shown in FIG. 7(*a*).

In view of the above, in the method for discharging droplets of the present invention, a step is provided for adjusting the voltage applied to the drive elements PZ of the droplet discharge heads 5 prior to drawing on the color filter substrate P, which has yet to be corrected (before manufacture), and adjusting the discharge characteristics of the ink in the plurality of nozzles N. A step is also provided for drying the surface of the sheet member 15 by storing the sheet member 15 in the drying chamber 34 filled with drying gas so that a predetermined humidity is achieved, and adjusting the ink deposit surface area for the plurality of nozzles N.

The method for discharging droplets of the present invention is described below using an example.

Droplet Discharge Method

Figure 5:
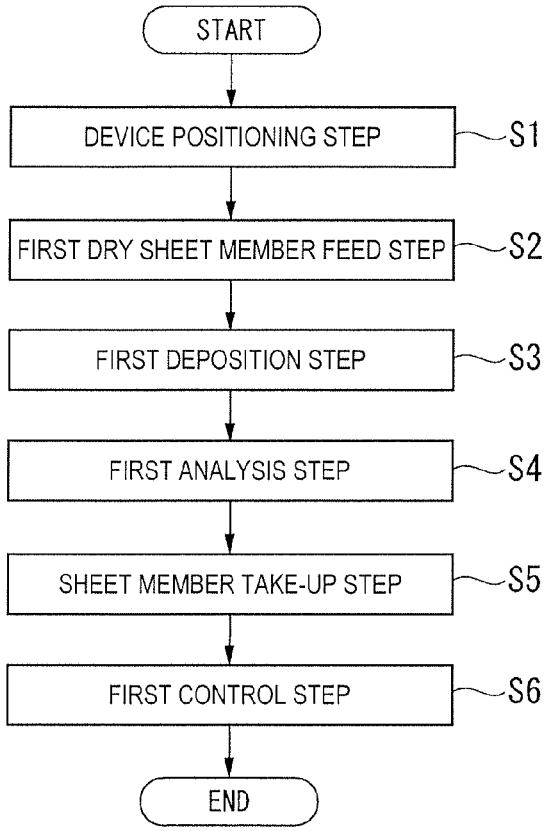
FIG. 5 is a flowchart showing the steps of the method for discharging droplets.

FIG. 5 is a flowchart showing the steps of the method for discharging droplets of the present invention. The method for discharging droplets of the present invention has a "device positioning step" (step S1) for arranging a device in a predetermined position to position the device; a "first dry sheet member feed step" (step S2) for feeding a sheet member 15 accommodated in the drying chamber 34 filled with a drying gas so that a predetermined humidity is achieved and the surface is dried; a "first deposition step" (step S3) for applying a constant voltage to the drive elements PZ and depositing ink on the sheet member 15; a "first analyzing step" (step S4) for measuring the first deposition surface area deposited on the sheet member 15 after the first deposition step, and calculating the distribution of the amount of ink discharged from the nozzles N; a "sheet member take-up step" (step S5) for taking up the sheet member 15; and a "first control step" (step S6) for adjusting the voltage applied to the drive elements PZ so that the amount of ink discharged from the nozzles N approximates a predetermined optimum amount.

First, the device is arranged in a predetermined position to position the device (step S1 of FIG. 5). Specifically, the sheet member conveyor platform 11 is moved in the X-axis direction toward the work stage 16 and arranged directly below the droplet discharge heads 5. The sheet member 15 on the sheet member conveyor platform 11 is thereby arranged so as to face the plurality of nozzles N of the droplet discharge heads 5.

Next, the sheet member 15 is fed, having been accommodated in the drying chamber 34 filled with a drying gas so that a predetermined humidity is achieved, and the surface is dried (step S2 of FIG. 5). Specifically, the drying-gas-introducing device 36 accommodated in the drying chamber 34 fills the drying chamber 34 with drying gas so that a predetermined humidity is achieved, and the surface of the sheet member 15 is dried. The sheet member 15 with a dried surface is fed by the feed reel 12 from the accommodation chamber 35 onto the sheet member conveyor platform 11.

In the present step, the drying chamber 34 is filled with drying gas so that the humidity is 40% or less. The surface of the sheet member 15 is thereby suitably dried. In the particular case of a droplet discharge device 1 having plurality of processing devices, the humidity of the entire line is set to 50 to 60%. Therefore, it is difficult to locally set, e.g., only the environment (the atmosphere for depositing ink on the sheet member 15) for discharging ink from the droplet discharge heads 5 to a humidity of 40% or less. Accordingly, the surface of the sheet member 15 is suitably dried before ink deposition by having the atmosphere; i.e., the humidity, set to 40% or less inside the drying chamber 34 in which the sheet member 15 is stored, at least before the ink is deposited on the sheet member 15.

In this manner, the nonuniformity of the deposition surface area in the plurality of nozzles N is adjusted by the drying-gas-introducing device 36 accommodated in the drying chamber 34. The nonuniformity of the ink deposit surface area in the plurality of nozzles N is thereby corrected. Accordingly, the ink deposit surface area for all the nozzles N of the droplet discharge heads 5 can be made uniform.

In contrast to the conventional method for measuring the weight of the ink discharged from the plurality of nozzles, a method is used in the present embodiment wherein the surface of the sheet member 15 is dried by having the sheet member 15 stored in a drying chamber 34 filled with drying gas so that a predetermined humidity is achieved, and the distribution of the ink discharge amount discharged from the plurality of nozzles N is calculated based on the ink deposit surface area for the plurality of nozzles N. Accordingly, the weight of the ink does not need to be measured as is conventionally performed, and considerable labor is not required.

Since the surface of the sheet member 15 is dried, the nonuniformity of the ink deposit surface area in the sheet member 15 is reduced. This is due to the fact that the surface of the sheet member 15 is dried, whereby the surface of the sheet member 15 is able to be uniformly ink-permeable. The ink-permeability of the sheet member 15 is described below by describing the state of the ink reception layer of the sheet member 15 before and after moisture absorption.

Figure 6:
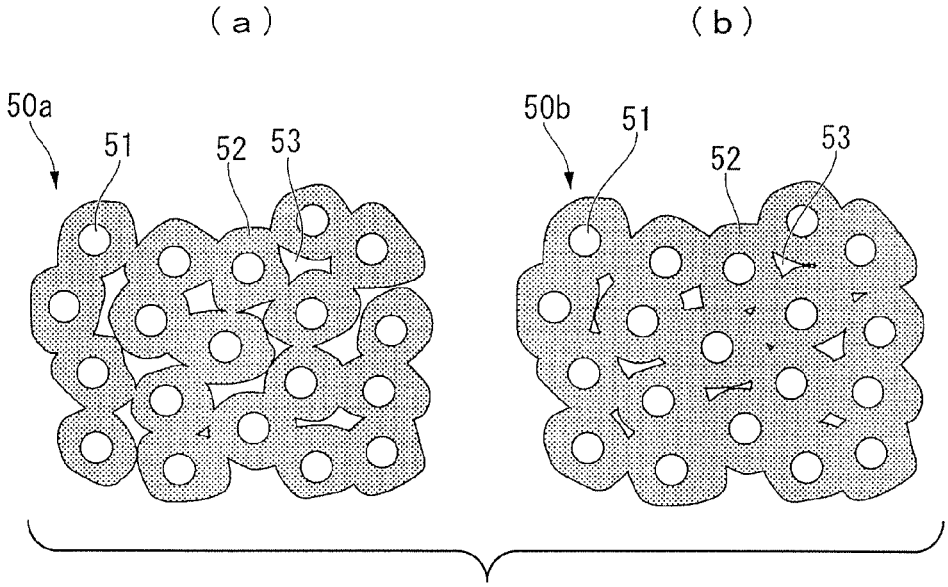
FIG. 6 is a diagram showing the state of the ink reception layer at the surface of the sheet member before and after moisture penetration.

FIG. 6 is a diagram showing the state of the ink reception layer of the sheet member 15 before and after moisture absorption. FIG. 6(*a*) is a view showing the state of ink reception layer 50*a* prior to moisture absorption. FIG. 6(*b*) is a view showing the state of ink reception layer 50*a* after moisture absorption.

The ink reception layers 50*a*, 50*b* include a plurality of pigments 51 and binders 52, as shown in FIGS. 6(*a*) and 6(*b*). The pigments 51 are contained in the binders 52. The ink reception layers 50*a*, 50*b* have a porous structure that has numerous spaces 53 between the plurality of binders 52. The ink reception layer 50*b* has spaces 53 that are smaller in size than those of the ink reception layer 50*a*. This is because the pigments 51 and the binders 52 constituting the ink reception layer expand by absorbing moisture.

Examples of organic pigments that can be used as the porous ink reception layer include light calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatom earth, calcium silicate, magnesium silicate, synthetic amorphous silica, colloidal silica, alumina, and alumina hydrate, aluminum hydroxide, lithopone, zeolite, hydrous halloysite, and magnesium hydroxide, and other white inorganic pigments, styrene-based plastic pigment, acrylic plastic pigment, polyethylene, microcapsules, and urea resin, and melamine resin. One of the above may be used alone, or two or more may be used in combination in the ink reception layer.

The binder contained in the ink reception layer as the pigment binding material may include a water-soluble or water-insoluble macromolecular compound having affinity with ink. Examples of the water-soluble macromolecular compound include methyl cellulose, methyl hydroxyethyl cellulose, methyl hydroxypropyl cellulose, hydroxy ethyl cellulose, and other cellulose-based adhesive materials; starches and modifications thereof; gelatins and modifications thereof; casein, pullulan, gum arabic, albumin, and other natural polymer resins and derivatives thereof; polyvinyl alcohol and modifications thereof; styrene-butadiene copolymers, styrene-acrylic copolymers, methyl methacrylate-butadiene copolymers, ethylene-vinyl acetate copolymers, and other latexes or emulsions; polyacrylamides, polyvinyl pyrrolidone, and other vinyl polymers; polyethyleneimine, polypropylene glycol, polyethylene glycol, maleic anhydride, and other copolymers.

Examples of the water-insoluble compound include ethanol, 2-propanol, or another alcohol; and water-insoluble adhesives dissolved in a mixed solution of water and the above-noted alcohols. Examples of such a water-insoluble adhesive include vinyl pyrrolidone/vinyl acetate copolymer, polyvinyl butyral, polyvinyl formal, and other acetal resins.

Ink is preferably deposited on the sheet member 15 before moisture penetrates the ink reception layer. However, since the pigments 51 and binders 52 constituting the ink reception layer have good hygroscopic properties, the permeability of the surface of the sheet member 15 becomes nonuniform due to the penetration or the like by airborne moisture into the pigments 51 and the binders 52 between storage and use (e.g., ink deposition step). Nonuniformity of the permeability of the surface of the sheet member 15 causes problems in the measurement of the area on the sheet member over which the ink is deposited 15.

In view of this situation, in the droplet discharge device 1 of the present invention, the surface of the sheet member 15 is dried in advance, and the size of the plurality of spaces 53 present between the plurality of binders 52 constituting the ink reception layer is made uniform overall before the ink is deposited, thereby making the permeability of the surface uniform. The area on the sheet member over which the ink is deposited 15 can thereby be measured with good precision. High controllability can also be obtained in subsequent adjustment of the ink discharge amount. In other words, nonuniformity of the ink deposit surface area generated between the plurality of nozzles N in the initial state (prior to correction) of FIG. 7(*a*) can be substantially averaged, as shown after correction in FIG. 7(*b*).

Next, a constant voltage is applied to the drive elements PZ and ink is deposited on the sheet member 15 (step S3 of FIG. 5). Ink can be deposited in the same manner as the color filter layer CF in a stripe array, delta array, mosaic array, or another suitable array mode. The state of ink discharged from the plurality of nozzles N of the droplet discharge heads 5 prior to correction (when discharging to the sheet member 15), and the state of ink discharged after correction (when discharging to the color filter substrate P) are thereby reliably brought to conformity with each other.

When deposited on the sheet member 15, the ink can be deposited in a plurality of cycles. Specifically, a first ink is initially deposited in a plurality of regions on the sheet member 15. A second ink is subsequently deposited in a region in which the first ink has not been deposited. Since the ink can be deposited through a plurality of repeated cycles, the sheet member 15 can be effectively used without waste.

Next, the ink deposit surface area deposited on the sheet member 15 is measured, and the distribution of the amount of ink discharged from the plurality of nozzles N is calculated (step S4 of FIG. 5) based on the measurement data of the resulting deposit surface area. Specifically, the deposit surface area of ink discharged from the plurality of nozzles N to the sheet member 15 is imaged using the surface area measurement camera 14 disposed in a position facing the upper surface of the sheet member 15. At this point, the magnification of the lens of the surface area measurement camera 14 can be set to a magnification of e.g., 4 to 10 from the viewpoint of measurement precision and measuring time. The number of nozzles N when the ink deposit surface area is measured can be set to, e.g., 20 to 30 from the viewpoint of measurement precision.

The image data of the ink deposit surface area captured by the surface area measurement camera 14 is presented to the analyzing unit 32. The area over which the ink is deposited by the nozzles N is measured by the analyzing unit 32, and the distribution of the amount of ink discharged from the nozzles N is calculated based on the measurement data of the discharge surface area. The distribution data of the amount of ink discharged from the nozzles N is presented to the control unit 31.

Next, the sheet member 15 is taken up (step S5 of FIG. 5). Specifically, the sheet member 15 on which ink has been deposited is taken up by the take-up reel 13. In other words, a new sheet member 15 that has been stored in the drying chamber 34, has a dried surface, and on which ink has not been deposited, is fed from the feed reel 12.

The voltage applied to the drive elements PZ is subsequently adjusted (step S6 of FIG. 5). Specifically, the voltage applied to the drive elements PZ provided to each of the plurality of nozzles N is adjusted by the control unit 31 so that the amount of ink discharged from the nozzles N approximates an optimum amount.

Figure 8:
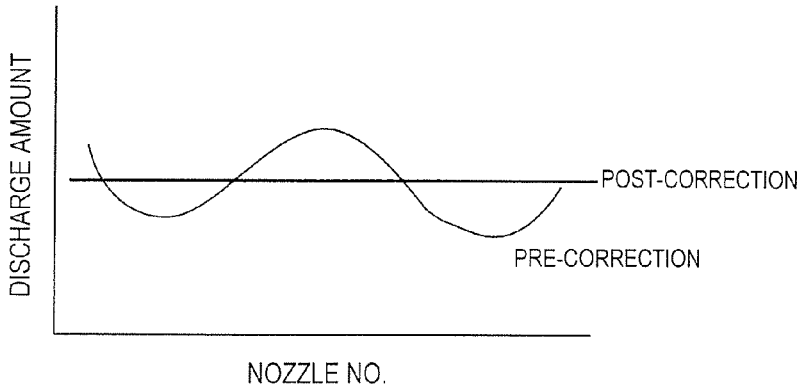
FIG. 8 is a diagram showing the discharge characteristics of the droplet discharge head before and after the nonuniformity of the ink discharge amount has been corrected.

FIG. 8 is a diagram showing the discharge characteristics of the droplet discharge head before and after correction of the nonuniformity of the ink discharge amount. The horizontal axis shows the nozzle numbers 1 through 180 of the nozzle rows NA and the vertical axis shows the amount discharged by the nozzles corresponding to the nozzle numbers. In view of the pre-correction solid line of the nonuniformity of the ink discharge amount, it is apparent that there is a tendency for the ink discharge amount to increase in a relative fashion in the nozzles in the center part and the two end parts, as shown in FIG. 8.

For example, a predetermined voltage is applied to the drive elements PZ that correspond to the nozzles of a region with relatively low ink discharge amounts in the initial state (see the solid line of prior to correction in FIG. 8). On the other hand, voltage is not applied to the drive elements PZ that correspond to areas with a relatively high ink discharge amount in the initial state.

Nonuniformity of the discharge amount produced among the plurality of nozzles N is thus adjusted by the drive elements PZ. The nonuniformity in the amount of ink discharged from the nozzles N is thereby corrected. In other words, the nonuniformity of the ink discharge amount produced among the plurality of nozzles N in the initial state (pre-correction solid line) can be substantially averaged as indicated by the post-correction solid line.

According to the droplet discharge device 1 of the present embodiment, the sheet member 15 in the drying chamber 34 filled with drying gas by the drying-gas-introducing device 36 so that a predetermined humidity is achieved, whereby the surface of the sheet member 15 is dried. The image of the deposited ink discharged from the plurality of nozzles N is captured by the surface area measurement camera 14. The distribution of the amount of ink discharged from the plurality of nozzles N is calculated by the analyzing unit 32 on the basis of the area over which the ink discharged from the plurality of nozzles N is deposited. At this point, the voltage applied to the drive elements PZ by the control unit 31 is adjusted so that the amount of ink discharged from the nozzles N approximates a predetermined optimal amount. In other words, the nonuniformity of the amount of ink discharged from the nozzles N is corrected by the control unit 31. Accordingly, a uniform amount of ink can be discharged from all the nozzles N of the droplet discharge heads 5. Since the surface of the sheet member 15 is dried, the nonuniformity of the area on the sheet member over which the ink is deposited 15 is reduced. In other words, the surface of the sheet member 15 has a predetermined ink-permeability and the permeability must be kept uniform, but in reality, the permeability of the surface becomes nonuniform due to some cause (e.g., airborne moisture penetrating or otherwise entering the ink reception layer of the surface of the sheet member 15) between storage and use (e.g., in the ink deposition step) of the sheet member 15. This leads to problems in the measurement of the area on the sheet member over which the ink is deposited 15. In view of the above, in the droplet discharge device 1 of the present invention, the surface of the sheet member 15 is stored in advance in the drying chamber 34 brought to a predetermined humidity by the drying-gas-introducing device 36, the surface of the sheet member 15 is dried, and the permeability of the surface is made uniform before ink is deposited. The area on the sheet member over which the ink is deposited 15 can thereby be measured with good precision. High controllability can also be obtained in subsequent adjustment of the ink discharge amount. Accordingly, the ink deposit surface area for all the nozzles N of the droplet discharge heads 5 can be made uniform. Therefore, striping can be made unnoticeable and any reduction in the image quality can be minimized. Having a larger number of steps, conventional methods of weighing ink discharged from a plurality of nozzles N offer lower productivity than what is achieved by a method in which the surface of the sheet member 15 is stored and thereby dried in a drying chamber 34 filled with drying gas by a drying-gas-introducing device 36 so that a predetermined humidity is achieved, and the distribution of the amount of ink discharged from the plurality of nozzles N is calculated on the basis of the area over which the ink is deposited by the nozzles N. The deposit surface area is measured with good efficiency because the sheet member 15 on which the ink discharged from the plurality of nozzles N has been deposited is suitably conveyed.

In accordance with this configuration, nonuniformity of the surface area of ink deposited on the sheet member 15 is considerably reduced because the drying chamber 34 is filled with drying gas so that the humidity becomes 40% or less, and the surface of the sheet member 15 is suitably dried. In the particular case of a droplet discharge device 1 having a plurality of processing devices, the humidity of the entire line is set to 50 to 60%. Therefore, it is difficult to locally set, e.g., only the environment (the atmosphere for depositing ink on the sheet member 15) for discharging ink from the droplet discharge heads 5 to a humidity of 40% or less. Accordingly, a dramatic effect is achieved because the surface of the sheet member 15 is suitably dried before ink deposition by having the atmosphere, i.e., the humidity, set to 40% or less inside the drying chamber 34 before the ink is deposited on the sheet member 15.

In accordance with this configuration, a highly uniform amount of ink is discharged from all the nozzles N of the droplet discharge heads 5, and the ink deposit surface area in all the nozzles N is considerably more uniform because the sheet member 15 has a porous ink reception layer in which pigments 51 are bound by binders 52. In the particular case that the sheet member 15 has a porous ink reception layer, the spaces of the ink reception layer becomes filled with absorbed moisture and the size of the spaces readily become nonuniform. Therefore, a dramatic effect is achieved because the permeability of the surface of the ink reception layer is considered to be a parameter that must be kept uniform.

In accordance with the method for discharging droplets of the present embodiment, the sheet member 15 dried by being stored in the drying chamber 34 filled with a drying gas so that a predetermined humidity is achieved is fed in the first dry sheet member feed step. Accordingly, in the first deposition step following the first dry sheet member feed step, the nonuniformity of the area on the sheet member over which the ink is deposited 15 is reduced. The distribution of the ink discharge amount on the plurality of nozzles N is calculated in the first analyzing step following the first deposition step. The amount of ink discharged from the nozzles N is adjusted in the first control step so as to approximate a predetermined optimal amount. Accordingly, the nonuniformity of the amount of ink discharged from the nozzles N is corrected. For this reason, a uniform amount of ink is discharged from all nozzles N of the droplet discharge heads 5, and the ink deposit surface area for all the nozzles N can be made uniform. Therefore, a loss of image quality can be reduced without noticeable striping.

In the method for discharging droplets described above, the drying chamber 34 is filled with gas in the first dry sheet member feed step so that a humidity of 40% or less is achieved, and the surface of the sheet member 15 is suitably dried. Therefore, the nonuniformity of the area on the sheet member over which the ink is deposited 15 can be considerably reduced. In the particular case of a droplet discharge device 1 having plurality of processing devices, the humidity of the entire line is set to 50 to 60%. Therefore, it is difficult to locally set, e.g., only the environment (the atmosphere for depositing ink on the sheet member) for discharging ink from the droplet discharge heads 5 to a humidity of 40% or less. Accordingly, a dramatic effect is achieved because the surface of the sheet member 15 is suitably dried before ink deposition by having the atmosphere, i.e., the humidity, set to 40% or less inside the drying chamber 34 before the ink is deposited on the sheet member 15.

In the method for discharging droplets of the present embodiment, it is possible to have at least one cycle comprising a second dry sheet member feed step for feeding the sheet member 15 stored and dried in the drying chamber 34 filled with drying gas so that the predetermined humidity is reached following the first control step; a second deposition step for depositing the ink on the sheet member 15 following the second dry sheet member feed step; a second analyzing step for measuring a second deposition surface area of the ink deposited on the sheet member 15, and calculating a distribution of the amount of ink discharged from the plurality of nozzles N following the second deposition step; and a second control step for adjusting the voltage applied to the plurality of drive elements PZ so that the amount of ink discharged from the nozzles N approximates a predetermined optimum amount from the distribution.

In accordance with this manufacturing method, a dry sheet member feed step, a deposition step, an analyzing step, and a control step are repeated a plurality of cycles after the first control step, whereby the nonuniformity of the amount of ink discharged from the nozzles N and the nonuniformity of the deposit surface area of the plurality of nozzles N is reliably adjusted. Accordingly, it is possible to discharge a highly uniform amount of ink from all the nozzles N of the droplet discharge heads 5 and to make the ink deposit surface area for all the nozzles N uniform. Therefore, any reduction image quality is considerably minimized without noticeable striping.

In the droplet discharge device 1 described above, the drying-gas-introducing device 36 is accommodated in the drying chamber 34 (bottom part), but no limitation is imposed thereby. For example, the drying-gas-introducing device 36 may be externally provided to an outside wall of the drying chamber 34 and connected to the drying chamber 34 via a pipe. In other words, the drying-gas-introducing device 36 may be arranged to have the drying chamber 34 filled with drying gas so that a predetermined humidity is achieved.

In the method for discharging droplets described above, the ink deposited in the second deposition step can be deposited in the same manner as the color filter layer CF in a suitable array mode in similar fashion to the first deposition step described above (step S3 of FIG. 5). The discharge state in the plurality of nozzles N of the droplet discharge heads 5 prior to correction, and the discharge state after correction are thereby reliably brought to conformity with each other.

In accordance with the method for manufacturing a color filter of the present invention, a uniform amount of ink is discharged from all the nozzles of the droplet discharge heads as described above, and the ink deposit surface area of all the nozzles is made uniform. Therefore, a high quality color filter can be manufactured without striping.

In the embodiment described above, a case was described for manufacturing a color filter using a droplet discharge device 1 in which the nonuniformity of the ink deposit surface area among the nozzles has been adjusted, but no limitation is imposed thereby. For example, the droplet discharge device 1 of the present invention is not required to be used for manufacturing a color filter, but may also be applied in a film formation step in which a uniform film thickness is required and the formation of striping is a problem.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A droplet discharge device comprising:

a droplet discharge head having a plurality of nozzles configured and arranged to discharge a functional liquid, and a plurality of drive elements provided in correspondence with the nozzles;

a feed reel configured and arranged to feed a sheet member;

a drying chamber configured and arranged to be filled with a drying gas and accommodate the sheet member, the feed reel being disposed inside the drying chamber such that the drying chamber encloses the feed reel;

a drying-gas-introducing device configured and arranged to introduce the drying gas to the drying chamber so that the interior of the drying chamber reaches a predetermined humidity that is lower than a humidity within the droplet discharge device;

a take-up reel configured and arranged to take up the sheet member fed from the feed reel;

an imaging device configured and arranged to capture an image of the functional liquid discharged from the nozzles onto the sheet member between the feed reel and the take-up reel with the sheet member having been dried in the drying chamber filled with the drying gas;

an analyzing unit configured to perform image processing on the image captured by the imaging device, to measure an area over which the functional liquid is deposited on the sheet member from each of the nozzles, and to calculate a distribution of a discharge amount of the functional liquid from each of the nozzles based on the measured areas; and a control unit configured to adjust a voltage applied to the drive elements so that the discharge amount of the functional liquid from each of the nozzles approximates a predetermined optimum amount from the distribution, the droplet discharge head being configured and arranged to discharge the functional liquid on the sheet member that has been fed out of the drying chamber by the feed reel.

2. The droplet discharge device according to claim 1, wherein the predetermined humidity is set to 40% or less.

3. The droplet discharge device according to claim 1, wherein the sheet member has a porous ink reception layer in which pigments are bound by a binder.

4. A method for discharging droplets comprising:

feeding by a feed reel a sheet member that has been accommodated and dried in a drying chamber filled with a drying gas so that a predetermined humidity within the drying chamber is lower than a humidity in a droplet discharge device, the droplet discharge device including the drying chamber, the feed reel being disposed inside the drying chamber such that the drying chamber encloses the feed reel;

depositing a functional liquid on the sheet member from a plurality of nozzles of a droplet discharge head by applying a voltage to each of a plurality of drive elements provided in correspondence with the nozzles after the sheet member is fed out of the drying chamber by the feed reel;

measuring a first area over which the functional liquid is deposited on the sheet member from each of the nozzles, and calculating a distribution of a discharge amount of the functional liquid from each of the nozzles based on the measured first areas; and adjusting the voltage applied to the drive elements so that the discharge amount of the functional liquid from each of the nozzles approximates a predetermined optimum amount from the distribution.

5. The method for discharging droplets according to claim 4, wherein the predetermined humidity is set to 40% or less.

6. The method for discharging droplets according to claim 4, further comprising at least one cycle of feeding an additional sheet member accommodated and dried in the drying chamber filled with the drying gas after the adjusting of the voltage applied to the drive elements, depositing the functional liquid on the additional sheet member from the nozzles by applying the adjusted voltage to the drive elements, measuring a second area over which the functional liquid is deposited on the additional sheet member from each of the nozzles, and calculating a distribution of a discharge amount of the functional liquid from each of the nozzles based on the measured second areas, and readjusting the voltage applied to the drive elements so that the discharge amount from each of the nozzles approximates the predetermined optimum amount from the distribution.

7. A method for manufacturing a color filter comprising arranging the functional liquid in a predetermined region provided on a substrate to form a color filter using the method for discharging droplets according claim 4.

* * * * *